United States Patent [19]

Langford et al.

[11] 4,197,917

[45] Apr. 15, 1980

[54] SOIL STABILIZER INCLUDING TWO BANKS OF PLOUGH SHARES

[76] Inventors: Terrence R. Langford, 27 Bluegum Ave., Bordeaux, Randburg 2194; Ernest L. Rehm, P.O. Box 3, Walkerville 1876, both of South Africa

[21] Appl. No.: 888,471

[22] Filed: Mar. 20, 1978

[51] Int. Cl.[2] ..... A01B 3/26; E02F 3/76

[52] U.S. Cl. ..... 172/686; 172/784

[58] Field of Search ..... 172/159, 196, 197, 199, 172/642, 686, 688, 689, 708, 784, 785

[56] References Cited

U.S. PATENT DOCUMENTS

| | | | |
|---|---|---|---|
| 308,667 | 12/1884 | Haven | 172/159 |
| 486,614 | 11/1892 | Lindgren | 172/686 X |
| 1,221,565 | 4/1917 | Mintern | 172/688 X |
| 1,601,512 | 9/1926 | Silaj | 172/159 |
| 2,343,795 | 3/1944 | Pellett | 172/785 |
| 2,430,223 | 11/1947 | Goode | 172/708 X |
| 2,573,281 | 10/1951 | Schumacher | 172/688 |
| 3,135,339 | 6/1964 | Fry et al. | 172/688 X |
| 3,185,220 | 5/1965 | Tanoue | 172/159 X |

FOREIGN PATENT DOCUMENTS

| | | | |
|---|---|---|---|
| 885939 | 8/1953 | Fed. Rep. of Germany | 172/159 |
| 2264468 | 10/1975 | France | 172/159 |
| 98871 | 11/1961 | Norway | 172/784 |

*Primary Examiner*—Richard T. Stouffer
*Attorney, Agent, or Firm*—Kenyon & Kenyon

[57] ABSTRACT

A soil stabilizer comprises a front bank of four ploughs inclined at 45° to the direction of movement and a similar rear bank of ploughs. The ploughs are arranged in pairs whereof the front ploughs toss the soil/stabilizer mixture to one side where it is engaged by the rear plough which tosses to the other side. The ploughs are mounted on a frame which may be carried by pivoted arms on a road grader or may be mounted on ground engaging wheels.

12 Claims, 5 Drawing Figures

10
18
20
28
12
40
22
14
19
16
20
52

32
36
28
44
42
22
44
42
38
34
48
52
55
48
58
50
54
50
54

SOIL STABILIZER INCLUDING TWO BANKS OF PLOUGH SHARES

This invention relates to methods of and apparatus for use in soil stabilization and in particular for the stabilization of the top layer and/or sub base of soil in road and highway construction.

The sub-base normally requires to be stabilized by Heckette's slag and borrowed soil. The top layer of soil in the highway requires to be stabilized by the addition of stabilizing material such as lime, slag cement or the combination of lime and slag cement. This stabilizing material must be mixed with the soil of this layer so as to provide a substantially even mixing throughout the layer. In certain countries where there is a substantial and regular rainfall the layer may comprise pre-mixed soil/stabilizer which can immediately be levelled and compacted. However this pre-mixed mixture is expensive and uneconomical when compared with a mixture that is mixed on site as can be done in drier conditions where the possibility of rain falling and leaching the stabilizing material out of the mixture after it has been spread out is reduced.

The mixing on site may be by use of a disc harrow or motor grader or both. Typically the motor grader runs up and down the road with the blade over the soil and stabilizing material again and again to form a substantially constant mixture. More complex machinery has also been devised for this purpose. A typical type of machine comprises fifteen rotors on a common shaft and each carrying four steel hook tines. The rotor tines are used as flails and mixers and serve to mix the soil and stabilizing material. This machine provides a thorough mixing and can also be put to other uses. However it is extremely expensive in capital cost and maintenance costs are also high.

BRIEF DESCRIPTION OF THE INVENTION

The present invention provides a soil stabilizing unit comprising two banks of plough shares arranged one before the other with the shares located in pairs so that rear share will engage the mixture tossed to one side by the front share and will toss it to the other side, the shares being preferably carried by a frame having means for engagement with draw means such as a grader or tractor. Conveniently there are fours shares in each bank of shares, two adjacent shares of each bank tossing the mixtures to one side and the other two adjacent shares tossing the mixture to the other side.

Two embodiments of the invention will now be described by way of example with reference to the accompanying drawings.

SHORT DESCRIPTION OF DRAWINGS

Figure 1:
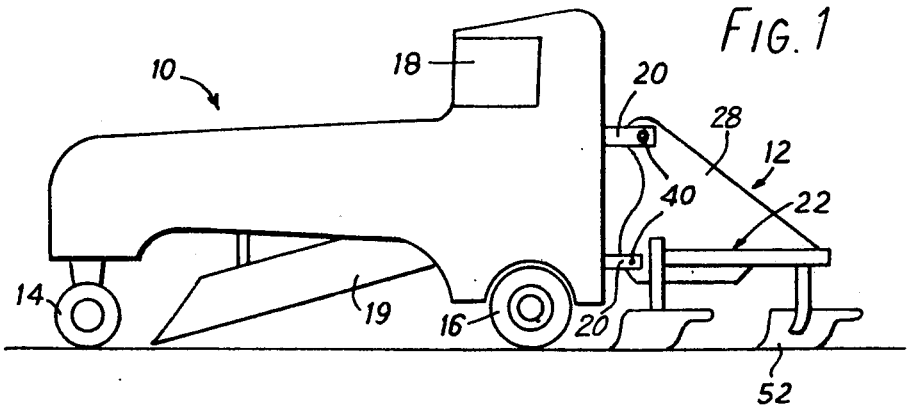
Figure 2:
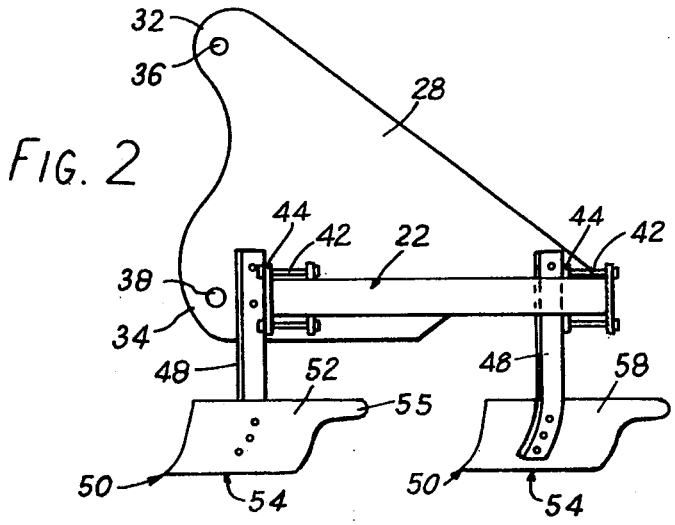
Figure 3:
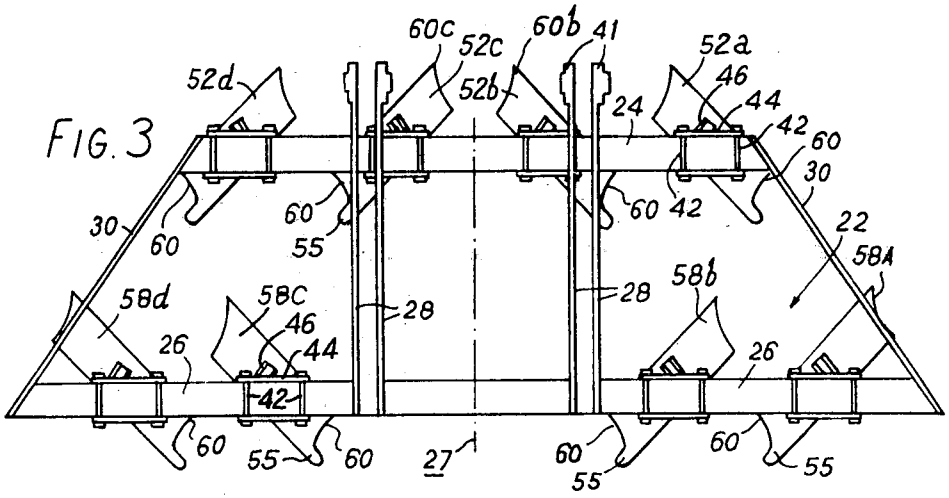
Figure 4:
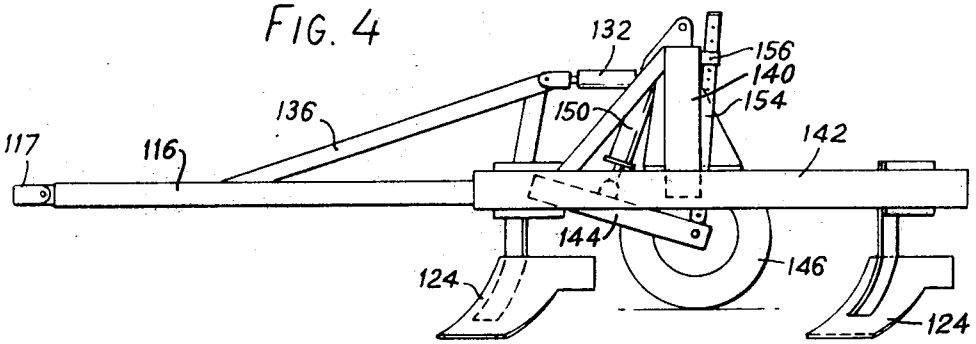
Figure 5:
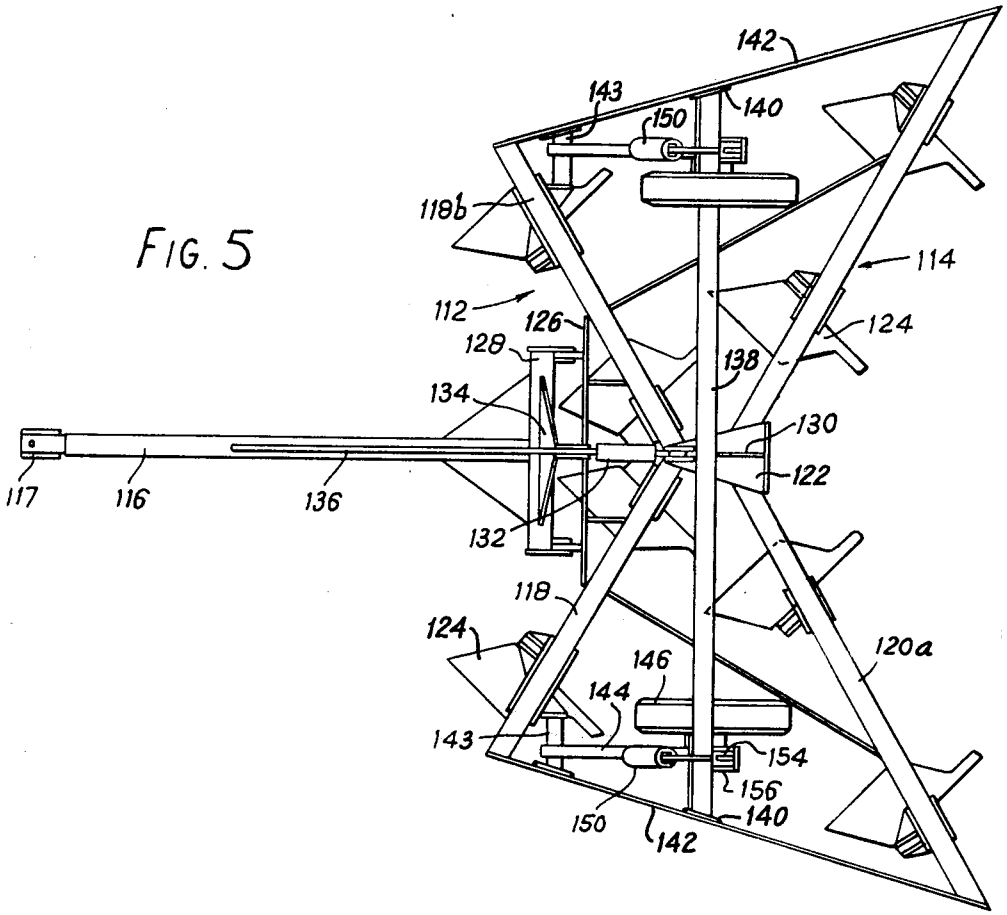

FIG. 1 is a diagrammatic side view of a grader carrying a soil stabilizer of the invention, FIG. 2 is a side view of the soil stabilizer, FIG. 3 is a plan view of the soil stabilizer, FIG. 4 is a side view of a modified soil stabilizer of the invention, and FIG. 5 is a plan view of the soil stabilizer of FIG. 4.

DESCRIPTION OF CURRENTLY PREFERRED EMBODIMENT

Reference is made to FIGS. 1, 2 and 3. In these Figures there is shown a prime mover such as a motor grader 10 to which is attached a soil stabilizer 12 of the invention. As is well known, the grader 10 has front and rear wheels 14 and 16 respectively with a driver's cabin 18 above the rear wheels 16. The grader carries a blade 19. At the rear, the grader 10 has four lifting arms 20. These arms 20 may be hinged or operate on a parallel motion depending upon the particular model of grader.

The soil stabilizer 12 comprises a frame 22. The frame 22 comprises a pair of parallel, robust, horizontal members 24 and 26, the front one (24) of which is shorter than and located centrally relative to the rear member 26 and which are arranged at right angles to the central longitudinal plane 27 of the frame 22. Four robust vertical plates 28 and two end members 30 connect the front and rear horizontal members. The plates 28 are arranged in two pairs equi-spaced relative to the longitudinal axial plane 27 of the frame 22 and serve as a means for connecting the frame 22 to the arms 20 of the grader 10. The plates of each pair are close together and spaced to receive between them the ends of the lifting arms 20.

The plates 28 are each generally of right angled triangular shape with the front edge or side vertical. Near the apices 32 and 34 of this front side, there are provided apertures 36 and 38 through which pass pins 40 (see FIG. 1) whereby the plates 28 are secured to the arms 20. Low bosses 41 (FIG. 3) are provided about the apertures 36 and 38 on the outside faces of the plates for strengthening purposes.

Clamped by means of tie bolts 42 to the horizontal members 24 and 26 are carrying plates 44 each having a forwardly projecting lug 46 inclined to the axial plane 27. To each lug 46 there is bolted a spring steel plough arm 48 which at its lower end carries the mould board 50 of a plough share 52, 58. These mould boards are approximately 460 mm long and 460 mm high. The shares 52, 58 are arranged with their lower edges 54 horizontal so that they have a zero angle of attack. An enlarged ear 55 at the upper rear edge of the share 52, 58 extends beyond the body of the mould board to assist in turning and spreading the material to be mixed.

There is a bank of four shares 52 attached in the above manner to the front horizontal member 24 and a bank of four shares 58 attached to the rear member 26.

The two shares **52*b* and 52*c* in the centre of the member 24 are inclined from left to right and from right to left respectively (in this specification to say that a share is inclined from left to right means that the front edge is to the left of the rear edge and the reverse applies when it is stated that the share is inclined from right to left) with the leading edges 60*b* and 60*c* of both shares closer than the rear edges. These edges are however sufficiently spaced (by about 0.5 meters) to allow a rock or other impediments to pass therebetween and also to avoid "bull-dozing". The shares 52*a* and 52*d*** are inclined in the parallel directions to the shares to which they are adjacent.

The shares 58 are arranged in pairs (designated by the same suffix a, b, c and d) with the shares 52 i.e. these shares are located so that in use, the soil is tossed away from the central plane 27 by the share 52 of the pair and will be engaged by the share 58 of the pair and tossed towards the central plane 27. The shares of each pair of shares are inclined in opposite directions at 45° to the plane 27, i.e. the shares of each pair are inclined at 90° to one another.

In order to fulfill the operational requirement mentioned above, the rear edges 60 of the two shares of a pair are approximately aligned in the direction of the plane 27 i.e. at right angles to the horizontal members 24 and 26.

We have found that the stabilizer above described provides for an extremely efficient mixing of the soil and stabilizing material for the top layer of a road or highway. The time taken, in our experience is about a quarter of the time taken for the operation when carried out by the grader using its blade alone. More than one pass is normally required for the mixing operation, but many less passes are required than are necessary when mixing by a grader blade. It will be understood that after the mixing operation the soil of the top layer will have to be levelled off and thereafter compacted in normal manner.

We have also found that the soil stabilizer above described is easily transportable,. inexpensive to maintain and extremely robust. It can be operated by a grader driver without specialised training. The soil stabilizer 12 can be raised by the grader and the latter can travel in the normal way.

The soil stabilizer is also extremely effective as the outer rear plough shares can be positioned closely adjacent the curb or gutter which is often pre-formed before the soil stabilization operation. The provision of spring steel plough arms helps to absorb excessive shock loading of the plough shares and mould boards due to rocks, clods, tree stumps or other items in the path of the plough.

Reference is now made to FIGS. 4 and 5. The soil stabilizer 112 here shown is adapted to be towed behind a tractor or the like (not shown). The stabilizer 112 comprises a frame 114 which includes a draw bar 116 having a universally swivellable connection 117 at its front end so that the stabilizer can move relative to the tractor which is towing it and can thus compensate for irregularities in the ground surface, inclinations, etc.

The frame 114 also comprises four robust, horizontal members 118*a*, 118*b* and 120*a* and 120*b* arranged in an "X" formation, the members 118 being of the same length, shorter than and located in front of the members 120. The members are connected together by a short central member 122 which is aligned with the draw bar that is itself located on the longitudinal axis of the frame. These members 118 and 120 respectively carry front and rear banks of plough shares 124 in the same manner and in the same disposition as do the members 24 and 26 in the first described embodiment. Also carried by the frame 114 is a front plate 126 to which a cross-member 128 at the rear of the draw bar 116 is pivotally connected. A vertical member 130 stands up from the rear of the central member 122 and this is connected by means of a turnbuckle 132 to an upright plate 134 upstanding from the cross-member 128. A gusset plate 136 extends from the plate 134 to the draw bar 116 near to the front end thereof.

The vertical member 130 is also connected to a robust cross-member 138 carried on uprights 140 that are secured to side pieces 142 at the ends of the frame. A short trunnion 143 extends from each member 118 to the adjacent side piece 142. An arm 144 carrying a ground engaging, frame carrying, wheel 146 is pivoted on each trunnion 143. An hydraulic jack 150 extends between a lug 152 on the cross-member 138 and the arm 144. This jack 150 controls the height of the frame 114 above the ground and thus the depth of the ploughs 124 in the top soil.

A narrow upright plate 154 stands up from the end of the arm 144 and passes through a pair of lugs 156. This plate 154 has apertures for pins that engage the lugs 156. This limits the depth to which the ploughs can be lowered.

As mentioned in the preceding paragraph, depth control of the stabilizer 112 is effected by the wheels 146 and jacks 150. In the first embodiment this is effected by the link arrangement of the scraper.

The invention is not limited to the precise constructional details above described. For example each stabilizer may comprise more plough shares as desired. The inclination of the plough shares can also be altered if desired between about 30° and about 70° but preferably between about 40° and about 50° the plough of a pair would be inclined at different angles.

We claim:

1. A soil stabilizer for mixing soil comprising a frame having means for connecting said frame to a prime mover for movement in a given direction;

a forward bank of plough shares mounted on said frame, said plough shares being at least four in number, each said plough share consisting of a single mold board inclined at an angle to a central longitudinal plane of said frame with a front edge being directed in one direction relative to said plane, said one direction being one of the directions of toward and away from said plane;

each of said plough shares on one side of said central longitudinal plane being inclined in the same direction relative to said plane and each of said plough shares on the opposite side of said plane being inclined in a direction opposite to said same direction relative to said plane; and a rear bank of plough shares mounted on said frame to the rear of said forward bank of plough shares relative to the movement of said frame in said given direction, each said plough share of said rear bank being inclined at an angle to said longitudinal plane of said frame and consisting of a single mold board with a front edge directed in a direction opposite to said one direction relative to said plane whereby a plough share of said forward bank will turn over the soil in one direction and a following share of said rear bank will turn over that soil in the opposite direction.

2. A soil stabilizer as set forth in claim 2 wherein said plough shares have flat lower edges which are arranged at zero angle of attack.

3. A soil stabilizer as set forth in claim 1 wherein said plough shares are inclined at between about 30° and about 70° to said longitudinal plane.

4. A soil stabilizer as set forth in claim 4 wherein said plough shares are inclined at between about 40° and about 50° to said longitudinal plane.

5. A soil stabilizer as set forth in claim 5 wherein said plough shares are inclined at between about 45° to said longitudinal plane.

6. A soil stabilizer as set forth in claim 1 wherein each plough share of said forward bank has a front edge directed towards said longitudinal plane of said frame and each plough share of said rear bank has a front edge directed away from said plane.

7. A soil stabilizer as set forth in claim 1 wherein each outermost plough share of said rear bank has a front edge directed away from said longitudinal plane of said frame.

8. A soil stabilizer as set forth in claim 1 wherein said shares of said forward back are disposed in two groups on opposite sides of said longitudinal plane, each said group being disposed to toss soil away from said plane with the innermost shares of said groups being spaced from each other to permit matter to pass therebetween.

9. A soil stabilizer as set forth in claim 1 wherein each share of said rear bank is located relative to a respective share of said forward bank to toss soil therefrom in an opposite direction, each said share of said rear bank being inclined to said plane at the same angle as said respective share but in a negative sense.

10. A soil stabilizer as set forth in claim 1 wherein each plough share has a lower horizontal edge disposed in a common horizontal plane.

11. A soil stabilizer as set forth in claim 1 wherein said frame includes a plurality of horizontal members arranged in an X-formation to carry said front and rear banks of plough shares thereon.

12. A soil stabilizer as set forth in claim 1 wherein said frame includes four horizontal members arranged in an X-formation, two of said members being shorter than and arranged in front of the remaining two members relative to said given direction, said two shorter members having said forward bank of plough shares mounted thereon and said remaining two members having said rear bank of plough shares mounted thereon.

* * * * *

UNITED STATES PATENT AND TRADEMARK OFFICE

CERTIFICATE OF CORRECTION

PATENT NO. : 4,197,917

DATED : April 15, 1980

INVENTOR(S) : Terrence Ronald Langford et al

It is certified that error appears in the above—identified patent and that said Letters Patent is hereby corrected as shown below:

Column 2, line 43, change "centre" to --center--

Column 4, line 44, change "claim 2" to --claim 1--

Column 4, line 51, change "claim 4" to --claim 1--

Column 4, line 54, change "claim 5" to --claim 1--

Column 4, line 67, change "back" to --bank--

Signed and Sealed this

*Twenty-third* Day of *September 1980*

[SEAL]

*Attest:*

SIDNEY A. DIAMOND

*Attesting Officer*

*Commissioner of Patents and Trademarks*